US009851070B2

(12) United States Patent
Rich et al.

(10) Patent No.: US 9,851,070 B2
(45) Date of Patent: Dec. 26, 2017

(54) SYSTEMS AND METHODS TO IMPART VISUAL QUALITY TO ILLUMINATION SYSTEMS

(71) Applicant: Wavefront Technology, Inc., Paramount, CA (US)

(72) Inventors: Christopher Chapman Rich, Rancho Palos Verdes, CA (US); Phillip Christopher Harvey, Long Beach, CA (US); Eric William Hearn Teather, Elkton, MD (US); Joel Mikael Petersen, Valley Village, CA (US)

(73) Assignee: Wavefront Technology, Inc., Paramount, CA (US)

( * ) Notice: Subject to any disclaimer, the term of this patent is extended or adjusted under 35 U.S.C. 154(b) by 116 days.

(21) Appl. No.: 14/481,792

(22) Filed: Sep. 9, 2014

(65) Prior Publication Data

US 2015/0070901 A1 Mar. 12, 2015

Related U.S. Application Data

(60) Provisional application No. 61/875,543, filed on Sep. 9, 2013.

(51) Int. Cl.
*F21V 3/00* (2015.01)
*F21V 5/00* (2015.01)
(Continued)

(52) U.S. Cl.
CPC ..... *F21V 5/02* (2013.01); *F21K 9/60* (2016.08); *F21V 5/005* (2013.01); *F21V 5/045* (2013.01); *F21Y 2115/10* (2016.08)

(58) Field of Classification Search
CPC . F21V 5/02; F21V 5/045; F21V 5/005; F21K 9/50; F21Y 2101/02
(Continued)

(56) References Cited

U.S. PATENT DOCUMENTS 3,330,908 A 7/1967 Good et al.
3,661,385 A 5/1972 Scheider
(Continued)

FOREIGN PATENT DOCUMENTS

JP 2003-131607 5/2003
WO WO 2014004882 A2 * 1/2014 ..... G02B 5/09

OTHER PUBLICATIONS

International Search Report and Written Opinion for International Application No. PCT/US2014/054827, dated Jan. 27, 2015.
(Continued)

*Primary Examiner* — Elmito Breval
*Assistant Examiner* — Glenn Zimmerman
(74) *Attorney, Agent, or Firm* — Knobbe Martens Olson & Bear LLP

(57) ABSTRACT

Implementations disclosed herein include optical sheets comprising one or more regions including one or more optical elements. Each of the one or more optical elements includes a plurality of microstructures. The one or more optical elements can be configured to tailor the radiation pattern output from a source of illumination. The one or more optical element can be further configured to impart a visual appearance to the optical sheet that is different from a standard lenticular or prismatic sheet. In various implementations, the one or more regions can be demarcated from each other or the surrounding by borders. The borders of the one or more regions can be configured to form one or more letters, one or more symbols or logos for identification and/or security purposes. Various implementations of the optical sheet can include nano-particles in addition to the optical elements to enhance the aesthetic quality of the optical film.

22 Claims, 13 Drawing Sheets

(51) Int. Cl.

| | |
|---|---|
| ***F21V 5/02*** | (2006.01) |
| ***F21V 5/04*** | (2006.01) |
| ***F21K 9/60*** | (2016.01) |
| *F21Y 115/10* | (2016.01) |

(58) Field of Classification Search
USPC ..... 362/311.01, 326, 336, 339
See application file for complete search history.

(56) References Cited

U.S. PATENT DOCUMENTS

| | | | | |
|---|---|---|---|---|
| 4,346,449 | A | 8/1982 | Ovshinsky et al. | |
| 4,492,442 | A | 1/1985 | Gaudyn | |
| 5,074,649 | A | 12/1991 | Hamanaka | |
| 5,130,852 | A | 7/1992 | Hamanaka | |
| 5,177,637 | A | 1/1993 | Tsukada | |
| 5,439,621 | A | 8/1995 | Hoopman | |
| 5,600,455 | A * | 2/1997 | Ishikawa | F21V 5/02 349/57 |
| 5,712,731 | A | 1/1998 | Drinkwater et al. | |
| 5,870,068 | A | 2/1999 | Hildebrand et al. | |
| 5,956,164 | A | 9/1999 | Waitts | |
| 6,014,259 | A | 1/2000 | Wohlstadter | |
| 6,339,509 | B1 | 1/2002 | Wakelin et al. | |
| 6,381,071 | B1 | 4/2002 | Dona et al. | |
| 6,624,934 | B1 | 9/2003 | Moshrefzadeh et al. | |
| 6,700,712 | B2 | 3/2004 | Servatius et al. | |
| 6,800,357 | B2 | 10/2004 | Keberlein | |
| 6,998,196 | B2 | 2/2006 | Rich et al. | |
| 7,298,533 | B2 | 11/2007 | Petersen et al. | |
| 7,429,437 | B2 | 9/2008 | Rich et al. | |
| 7,430,358 | B2 | 9/2008 | Qi et al. | |
| 7,513,668 | B1 * | 4/2009 | Peng | G02B 27/0103 362/23.01 |
| 2002/0105801 | A1 * | 8/2002 | Martineau | F21V 5/045 362/244 |
| 2004/0196516 | A1 | 10/2004 | Peterson et al. | |
| 2007/0112097 | A1 * | 5/2007 | Olson | B82Y 30/00 523/210 |
| 2007/0121227 | A1 * | 5/2007 | Wang | G02B 5/0231 359/831 |
| 2008/0203415 | A1 * | 8/2008 | Thompson | B29C 33/0022 257/98 |
| 2010/0085642 | A1 | 4/2010 | Drinkwater | |
| 2010/0284194 | A1 * | 11/2010 | Miyashita | F21V 5/04 362/311.09 |
| 2010/0315833 | A1 | 12/2010 | Holman et al. | |
| 2011/0007505 | A1 * | 1/2011 | Wang | F21S 8/086 362/235 |
| 2011/0037707 | A1 | 2/2011 | Radicojevic et al. | |
| 2011/0103072 | A1 * | 5/2011 | Jones | G02B 5/0226 362/317 |
| 2011/0149191 | A1 * | 6/2011 | Chen | G02F 1/133608 349/58 |
| 2011/0216411 | A1 * | 9/2011 | Reed | B29D 11/00605 359/530 |
| 2013/0222757 | A1 * | 8/2013 | Klein | G02C 7/14 351/111 |
| 2015/0160345 | A1 * | 6/2015 | Hines | G02B 5/09 250/203.4 |

OTHER PUBLICATIONS

Guyenot, et al., "Novel micro-optical components made from optical adhesives", Proc. of SPIE vol. 3135, Precision Plastic Optics for Optical Storage, Displays, Imaging, and Communications, pp. 106-111, Sep. 1997.

Hessler, et al., "Microlens arrays with spatial variation of the optical functions", Pure Appl. Opt. 6 (1997) 673-681.

* cited by examiner

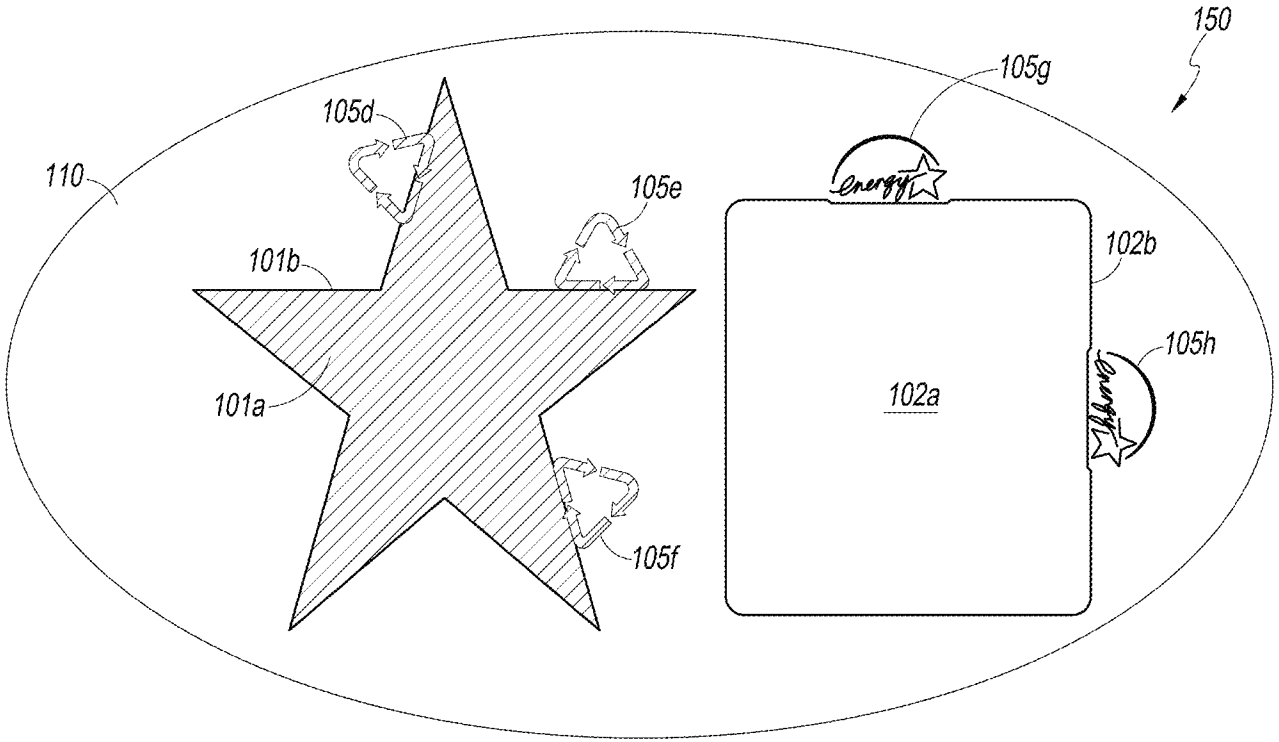
FIG. IB

SYSTEMS AND METHODS TO IMPART VISUAL QUALITY TO ILLUMINATION SYSTEMS

CROSS-REFERENCE TO RELATED APPLICATIONS

The present application claims benefit under 35 U.S.C. §119(e) of U.S. Provisional Application No. 61/875,543, filed on Sep. 9, 2013 and titled "LED Down Light Beam Control Using Surface Relief Microstructures in Plastic." The disclosure of the above identified provisional patent application is incorporated by reference herein in its entirety.

TECHNICAL FIELD

The present application generally relates to systems and methods to the control radiation pattern output from a luminaire and, in particular, to optical components including features that can alter the pattern of the output radiation.

DESCRIPTION OF THE RELATED TECHNOLOGY

Illumination systems and luminaires including one or more light source (e.g., light emitting diodes (LEDs), incandescent and fluorescent lights, etc.) and various optical components, such as, for example, reflecting elements, diffusing elements, collimating elements and/or focusing elements that can change the far field radiation pattern of the output light are available for indoor and outdoor residential or commercial lighting applications. Such illumination systems and luminaire's can provide different far-field illumination patterns for wide area lighting, spot lighting, flood lighting, task lighting, wall washing, etc. Many of the illumination systems and luminaire's are not necessarily configured in a manner that is aesthetically pleasing. Furthermore, standard illumination systems and luminaires including optical components that can alter the far-field pattern of the output light can be expensive, large, heavy and/or bulky.

SUMMARY

The systems, methods and devices of this disclosure each have several innovative aspects, no single one of which is solely responsible for the desirable attributes disclosed herein.

Various embodiments described herein comprise an optical sheet including one or more optical components that can be used to control the pattern and direction of light output from a light source installed in a light fixture for various residential and commercial lighting applications. The optical sheet can be optically transmissive, for example, translucent or reflective. The optical sheet can include a matrix of an optical material having a refractive index. The optical sheet can have a thickness between about 0.01 mm and about 10 mm. Various embodiments of the optical sheet can be flexible. Alternately, some embodiments of the optical sheet can be rigid. In various embodiments, the optical components can include refractive elements (e.g. lenses, microlenses, lenslets, arrays of spherical or cylindrical lenses, Fresnel lenses, prismatic elements with planar or curved facets, etc.), diffractive elements (e.g., gratings), diffusing elements, scattering elements, light redistributing elements, light reflecting elements, holographic elements, linear or non-linear grooves and/or protrusions, etc.

The one or more optical components can be disposed on a surface of the optical sheet and can include one or more optical features disposed on the surface of the optical sheet. For example, the optical features can be surface relief microstructures. In various implements, the size of the optical features can be between about 200.0 nm and about 2.0 mm. In some implementations, the optical features have a size such that they are not easily discernible or resolved by the naked human eye. The size and the shape of the optical features can impart a texture to the optical sheet. In various embodiments, the size and the shape of the optical features can be configured to impart unique and interesting visual qualities to the optical sheet such that the optical sheet visually appears different from standard lenticular or prismatic sheets. For example, the optical sheet can appear frosted, rippled, shiny, flashing, multicolored, brighter in the center, brighter at the edges, sparkling, wavy, shimmering, beaded, etc. In various embodiments, the optical sheet can have an appearance that is different from a lens.

Various embodiments disclosed herein include an illumination system and/or luminaire comprising a light source installed in a light fixture and the embodiments of optical sheet as discussed above disposed in front of the light source. In various embodiments, the light fixture can be a fixed can light wherein the fixture is recessed in the ceiling, wall and/or floor, a gimbal down light, a wall illumination light or a track light. In various implementations, the light fixtures could be circular or linear. In various embodiments, the light source can include one or more LEDs, incandescent light bulbs or fluorescent light bulbs. In some implementations, the light source can be a small volume bulb (e.g., a small volume incandescent light bulb or a LED). The one or more optical components included in the optical sheet can be configured to tailor the near-field and far-field radiation patterns of light output from the light source. For example, the size and the shape of the optical features disposed on the surface of the optical sheet can be configured to produce a desired far-field radiation pattern (e.g., spot light, flood light, wash light, collimated light, focused light, etc.) of the light output from the light source. Additionally, the size and shape of the optical features can be configured to impart an aesthetic quality to the illumination system and/or luminaire without affecting the far-field radiation pattern. For example, the size and the shape of the optical features can be configured such that the illumination system and/or luminaire appears rippled (e.g., like a surface of water), wavy, frosted, beaded, rainbow colored, flashing, shimmering, shining, etc. without affecting the far-field radiation pattern of the output light. Accordingly, embodiments of the optical sheets disclosed herein can be used to enhance the aesthetic qualities of illumination systems and luminaries, increase efficiency of light output and simultaneously provide a desired far-field radiation pattern (e.g., spot light, flood light, wash light, collimated light, focused light, etc.).

One innovative aspect of the subject matter described in this disclosure can be implemented in an optical sheet comprising a first region comprising one or more optical elements. Each of the one or more optical elements includes a plurality of microstructures. The one or more optical elements are configured to alter a far-field and/or a near-field radiation pattern of an incident beam. The first region includes a central portion and a border that visually demarcates the first region from a surrounding area. A portion of the border is configured to form at least one of text, a letter, a symbol, a number, an image, a picture or a character. A dimension of the text, the letter, the symbol, the number, the image, the picture or the character can between about 0.01% and about 50% of a corresponding dimension of the central portion. For example, a surface area of the text, the letter, the symbol, the number, the image, the picture or the character can between about 0.01% and about 50% of a surface area of the central portion.

In various implementations, at least one of the one or more optical elements can include a Fresnel lens. In various implementations, the text, the letter, the symbol, the number, the image, the picture or the character can be discerned by a naked human eye from a distance between about 6 inches and about 15 feet without aid of a magnifying element. In various implementations, the text, the letter, the symbol, the number, the image, the picture or the character cannot be discerned by a naked human eye without aid of a magnifying optical element. In various implementations, a section of the border forms a logo. In various implementations, the first region has a shape that is visible to the naked human eye from a distance between about 6 inches and about 15 feet. In various implementations, the plurality of microstructures can include at least one of a planar facet, a curved facet, a linear groove, a curvilinear groove or a holographic feature.

In various implementations, the surrounding area can include a second region comprising one or more optical elements, each of the one or more optical element including a plurality of microstructures. The second region includes a central portion and a border, wherein the second region is visually demarcated from the first region. In various implementations, the second region can surround the first region. In various implementations, the second region can adjoin the first region. In various implementations, the border can be the interface between the first region and the second region.

Another innovative aspect of the subject matter described in this disclosure can be implemented in an illumination system comprising a source of illumination; and the optical sheet disclosed above. The optical sheet can be disposed forward of the source of illumination. The source of illumination can comprise at least one of one or more LEDs, a small volume incandescent bulb or a fluorescent bulb. The optical sheet can be configured to alter the far-field radiation pattern of light output from the source of illumination. The far-field radiation can be a spot light, a flood light or a wash light.

Another innovative aspect of the subject matter described in this disclosure can be implemented an optical sheet comprising an optical element including a plurality of grooves disposed around an optical axis of the optical element. Each of the plurality of grooves includes a plurality of prismatic features. Each of the plurality of prismatic features has a primary optical facet and a secondary optical facet disposed at an angle with respect to the optical facet. The primary optical facet is disposed at a facet angle $\alpha$ less than about 90 degrees with respect to the optical sheet. The secondary optical facet is disposed at a facet angle $\beta$ less than about 90 degrees with respect to a normal to the optical sheet. The facet angle $\alpha$ has a value between about $\alpha_{nominal} \pm \Delta\alpha$ at a distance $r_0$ from the optical axis, wherein $\alpha_{nominal}$ varies monotonically with distance $r_0$, and wherein $\Delta\alpha$ has a value between about 10% and about 500% of $\alpha_{nominal}$.

One innovative aspect of the subject matter described in this disclosure can be implemented in an optical sheet comprising an optical element including a plurality of grooves disposed around an optical axis of the optical element. Each of the plurality of arcs grooves comprises a plurality of prismatic features. Each of the plurality of prismatic features has a primary optical facet and a secondary optical facet disposed at an angle with respect to the optical facet. The primary optical facet is disposed at a facet angle $\alpha$ less than about 90 degrees with respect to the optical sheet. The secondary optical facet is disposed at a facet angle $\beta$ less than about 90 degrees with respect to a normal to the optical sheet. The facet angle $\beta$ is configured such that between about 10% and about 95% of light incident on the secondary optical facet is redirected by the secondary optical facet and ejected out of the optical sheet along a desired direction.

Another innovative aspect of the subject matter described in this disclosure can be implemented in an optical sheet comprising an optical sheet comprising a matrix of an optical material having a refractive index, an optical element disposed on a surface of the optical sheet and a plurality of nano-particles disposed under the surface within said matrix of optical material. The optical element includes a plurality of grooves disposed around an optical axis of the optical element. Each of the plurality of grooves comprise a plurality of prismatic features. Each of the plurality of prismatic features has a primary optical facet and a secondary optical facet disposed at an angle with respect to the primary optical facet.

Details of one or more implementations of the subject matter described in this disclosure are set forth in the accompanying drawings and the description below. Other features, aspects, and advantages will become apparent from the description, the drawings and the claims. Note that the relative dimensions of the following figures may not be drawn to scale.

BRIEF DESCRIPTION OF THE DRAWINGS

FIGS. 1A and 1B illustrate embodiments of an optical sheet comprising a plurality of regions visually demarcated from each other by an edge surrounding each of the plurality of regions.

Like reference numbers and designations in the various drawings indicate like elements.

DETAILED DESCRIPTION

The following detailed description is directed to certain implementations for the purposes of describing the innovative aspects. However, the teachings herein can be applied in a multitude of different ways. As will be apparent from the following description, the innovative aspects may be implemented in any device that is configured to provide illumination. More particularly, it is contemplated that the innovative aspects may be implemented in or associated with a variety of applications such as commercial or residential lighting. Implementations may include but are not limited to lighting in offices, schools, manufacturing facilities, retail locations, restaurants, clubs, hospitals and clinics, convention centers, hotels, libraries, museums, cultural institutions, government buildings, warehouses, military installations, research facilities, gymnasiums, sports arenas, backlighting for displays, signage, billboards or lighting in other types environments or applications. Additionally, illumination systems and/or luminaires including various implementations of optical sheets described herein can be incorporated in or used as a building material, such as, for example, walls, floors, ceilings of residential and commercial structures. Other uses are also possible.

Figure 1A:
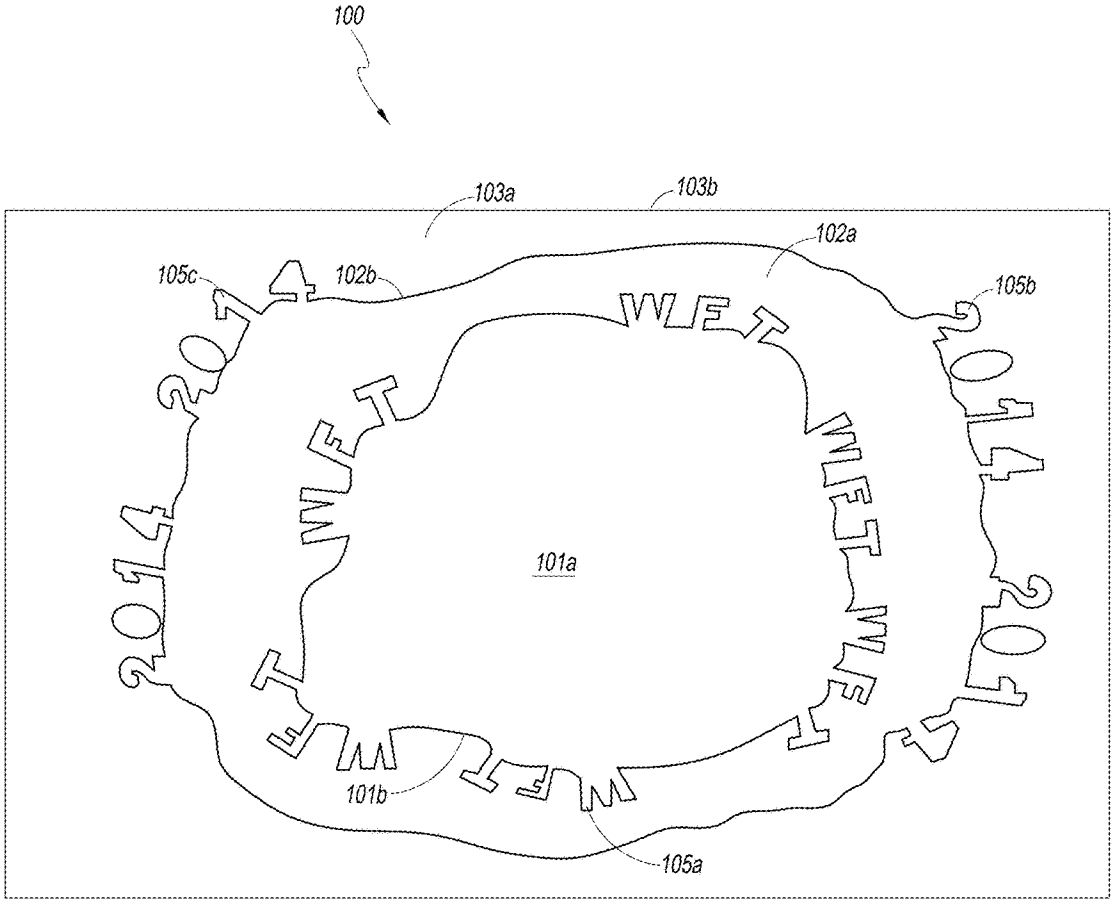

FIGS. 1A and 1B illustrate embodiments of an optical sheet 100 and 150 respectively, each embodiment of the optical sheet comprising a region 101*a* that includes one or more optical elements (e.g., lenses, Fresnel lenses, diffraction gratings, diffusing elements, scattering elements) that are configured to produce a first optical effect. Each of the one or more optical elements can comprise a set of microstructures. The region 101*a* comprises a central portion (also referred to as the bulk or primary region) and a border (or an edge) 101*b* surrounding the central portion. Without any loss of generality, the border 101*b* can be the interface between the region 101*a* and its surrounding area. In various implementations, the border 101*b* can include a portion of the set of microstructures forming one or more optical elements. For example, in some implementations a portion of the set of microstructures forming one or more optical elements can intersect the border 101*b*. [The border 101*b* can visually demarcate the region 101*a* from its surrounding such that the region 101*a* can be visually discerned by a naked eye from a distance (e.g., a distance between about 6 inches to about 15 feet). In various implementations, the area surrounding the region 101*a* can include a plurality of optical elements comprising a plurality of microstructures that are configured to produce one or more optical effects. For example, in FIG. 1A, the border 101*b* visually demarcates the region 101*a* from a region 102*a* that surrounds the region 101*a* and comprises a plurality of microstructures. In various implementations, the area surrounding the region 101*a* can be devoid of microstructures. For example, in FIG. 1B, the border 101*b* visually demarcates the star shaped region 101*a* from a region 110 of the optical sheet 150 that surrounds the region 101*a* and is devoid of microstructures.

Referring to FIGS. 1A and 1B, the border 101*b* is configured to form at least one of text, one or more letters (e.g., 105*a*), one or more numbers (e.g., 105*b* and 105*c*), one or more symbols (e.g., 105*d*, 105*e*, 105*f*), one or more image (possibly schematic), one or more picture (possibly sketched or schematic), one or more logos (e.g., 105*g*, 105*h*), or one or more characters. In various implementations, the boundary of one or more optical elements in region 101*a* could be shaped as text, one or more letters (e.g., 105*a*), one or more numbers (e.g., 105*b* and 105*c*), one or more symbols (e.g., 105*d*, 105*e*, 105*f*), one or more image (possibly schematic), one or more picture (possibly sketched or schematic), one or more logos (e.g., 105*g*, 105*h*), or one or more characters. For example, if region 101*a* includes one Fresnel lens, then the boundary of the Fresnel lens can be configured to form text, one or more letters (e.g., 105*a*), one or more numbers (e.g., 105*b* and 105*c*), one or more symbols (e.g., 105*d*, 105*e*, 105*f*), one or more image (possibly schematic), one or more picture (possibly sketched or schematic), one or more logos (e.g., 105*g*, 105*h*), or one or more characters.

In various implementations, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may have a size (or dimension) such that the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may not be discernible by a naked human eye without the aid of a magnifying optical element.

In various implementations, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may have a size (or dimension) such that the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may be visible to the naked human eye from a distance between about 6 inches and about 15 feet. For example, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may be visible to the naked human eye from a distance between about 6 inches and about 1 foot, between about 1 foot and about 3 feet, between about 3 feet and about 6 feet, between about 6 feet and about 10 feet, between about 10 feet and about 15 feet, In various implementations, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can have a size such that it may be visible to the naked human eye from a distance between about 15 feet and about 40 feet.

In various implementations, a dimension (e.g., a width, a height, a breadth, a depth, a surface area) of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters—is much smaller than a corresponding dimension e.g., a width, a height, a breadth, a depth, a surface area) of the region 101*a*. For example, the dimension (e.g., a width, a height, a breadth, a depth, a surface area) of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be between about 0.01% to about 50% of a corresponding dimension (e.g., a width, a height, a breadth, a depth, a surface area) of the bulk or primary region 101*a*. For example, in various implementations, the dimension (e.g., a width, a height, a breadth, a depth, a surface area) of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be between about 0.01% and about 1%, between about 1% and about 10%, between about 10% and about 20%, between about 20% and about 30%, between about 30% and about 40% or between about 40% and about 50% of a corresponding dimension (e.g., a width, a height, a breadth, a depth, a surface area) of the bulk or primary region 101*a*.

In various implementations, the ratio between the dimension of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters and a corresponding dimension of the region 101*a* is configured such that the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters does not affect the far-field radiation pattern produced by the one or more optical elements in region 101*a*.

The text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be advantageously used for identification purposes and/or security purposes. For example, a portion of the border 101*b* can be configured to form the name or logo of the corporation or individual making or using the optical sheets 100 and 150. As another example, a portion of the border 101*b* can be configured to form a number that designates the patent or trademark status of the product. The text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can also be advantageously used to provide useful information. For example, a portion of the border 101*b* can be configured to form a symbol or a logo (e.g., the recycle symbol, the energy star logo) that conveys information. As another example, a portion of the border 101*b* can be configured to form a symbol (e.g., an explosive symbol) that provides a warning or caution. As yet another example, a portion of the border 101*b* can be configured to form text providing instructions on how to install and/or use the optical sheet. In various implementations, a portion of the border 101*b* can be configured to form text, a symbol or a character that conveys the optical effect produced by the microstructures or identifies the product. For example, if the one or more optical elements are configured to provide a flood light, then a portion of the border 101*b* can be configured to form text, a symbol or a character that denotes flood light. Similarly, if the one or more optical elements are configured to provide a focused light, then a portion of the border 101*b* can be configured to form a text, a symbol or a character that denotes focused light.

In various implementations, a portion of the border 101*b* can be configured to form text, one or more symbols, one or more logos, one or more picture, or one or more characters that conveys source of origin, a logo of the company manufacturing or using the optical sheet, patent or trademark status of the product or other information that can be useful in branding/marketing of the optical sheet or the product including the optical sheet. The text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be used for many other purposes in addition to the ones described here.

Various implementations of the optical sheet 100 and 150 can include one or more additional regions (e.g., 102*a*, 103*a*) including one or more optical elements, each optical element configured to produce the same optical effect as region 101*a* (or the first optical effect) or additional optical effects that are different from the optical effect produced by region 101*a*. Each of the one or more optical elements in the one or more additional regions (e.g., 102*a*, 103*a*) can comprise a plurality of microstructures. The one or more additional regions can be surrounded or enveloped by the region 101*a*. Alternately, the one or more additional regions (e.g., 102*a*, 103*a*) can surround or envelop the region 101*a*, as shown in FIG. 1A. In such implementations, the border of region 101*a* is the interface between the region 101*a* and the surrounding region (e.g., 102*a* in FIG. 1A). In various implementations, the region 101*a* can be adjacent the additional regions (e.g., 102*a*, 103*a*). In such implementations, the additional regions (e.g., 102*a*, 103*a*) can be spaced apart from the region 101*a*, as shown in FIG. 1B. In such implementations, the border of region 101*a* is the interface between the region 101*a* and the surrounding region (e.g., 110 in FIG. 1B). Alternately, the additional regions (e.g., 102*a*, 103*a*) can be adjoining the region 101*a* and have a common boundary.

With continued reference to FIGS. 1A and 1B, the additional regions (e.g., 102*a*, 103*a*) can include a central portion and a border (e.g., 102*b*, 103*b*) surrounding the central portion. The borders (e.g., 102*b*, 103*b*) of the additional regions (e.g., 102*a*, 103*a*) can visually demarcate the corresponding additional regions (e.g., 102*a*, 103*a*) from the surrounding or the first region 101*a*. In various implementations, the borders 102*b* and 103*b* can comprise a portion of the microstructures forming the optical elements included in the regions 102*a* and 103*a* respectively. As discussed above, a portion of the border (e.g., 102*b*, 103*b*) can be configured to form text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters.

As discussed above, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters formed by a portion of the borders 102*b* and 103*b* may or may not be visible to the naked eye without the aid of a magnifying optical element.

As discussed above, a dimension (e.g., a height, a breadth, a width, a surface area) of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters formed by the borders 102*b*, 103*b* can be much smaller (e.g., between about 0.01% and about 1%, between about 1% and about 10%, between about 10% and about 20%, between about 20% and about 30%, etc.) than a corresponding dimension of the additional regions (e.g., 102*a*, 103 *a*) and/or the region 101*a*.

The microstructures in the first region 101*a*, the second region 102*a* and the third region 103*a* can have a feature size greater than or equal to about 200.0 nm and less than or equal to about 2.0 mm. For example, in various implementations, the feature size of the microstructures in the first region 101*a*, the second region 102*a* and the third region 103*a* can be greater than or equal to about 200.0 nm and less than or equal to about 1 μm, greater than or equal to about 1 μm and less than or equal to about 100 μm, greater than or equal to about 100 μm and less than or equal to about 500 μm, greater than or equal to about 500 μm and less than or equal to about 1 mm or greater than or equal to about 1 mm and less than or equal to about 2 mm. In various implementations, the dimension of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be one or more orders of magnitude (e.g., about 5 times to about 10 times, about 10 times to about 100 times, about 100 times to about 1000 times) larger than the feature size of the microstructures. Alternately, in some implementations, the dimension of the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters can be equal to the feature size of the microstructures.

In various implementations, each of the plurality of regions (e.g., 101*a*, 102*a*, 103*a*) can appear to the naked eye to have a shape determined by the corresponding border (e.g., 101*b*, 102*b*, 103*b*). To the naked eye, the border (e.g., 101*b*, 102*b*, 103*b*) can appear to comprise a plurality of linear and/or curvilinear segments. Each of the plurality of segments can have a length that is at least 10 times greater than the feature size of the microstructures in the first region 101*a*, the second region 102*a* and the third region 103*a*. For example, each of the plurality of segments can have a length that is about 5 times to about 10 times, about 10 times to about 100 times or about 100 times to about 1000 times greater than the feature size of the microstructures in the first region 101*a*, the second region 102*a* and the third region 103*a*. The plurality of linear and/or curvilinear segments can form a closed curve. In various implementations, the plurality of linear and/or curvilinear segments can be arranged to form a rotationally symmetric shape (e.g., square, rectangle, circle, flower shaped, star shaped, oval, etc.). In various implementations, the border (e.g., 101*b*, 102*b*, 103*b*) can be configured to form shapes and/or structures that are repeated periodically or quasi-periodically. In various implementations, the border (e.g., 101*b*, 102*b*, 103*b*) can include a plurality of linear segments arranged such that each of the plurality of regions (101*a*, 102*a*, 103*a*) has a polygonal shape (e.g., triangle, square, rectangle, rhombus, parallelogram, trapezoid, pentagon, hexagon, octagon, decagon, a star, etc.). In such implementations, each of the plurality of segments can have a slope that is different from the adjoining segments. In various implementations, the border (e.g., 101*b*, 102*b*, 103*b*) can include a plurality of curved segments (e.g., arcs) to form a symmetric or an asymmetric closed curve. For example, in various implementations, the plurality of regions (e.g., 101*a*, 102*a*, 103*a*) can have a circular shape, an elliptical shape, a tear drop shape, an oval shape, a flower shape, a clover leaf shape, etc. In various implementations, one or more of the plurality of regions (e.g., 101*a*, 102*a*, 103*a*) can be irregularly shaped and thus asymmetrical.

In various implementations, the microstructures in the first region 101*a*, the second region 102 and the third region 103*a* can comprise at least one or more grooves, one or more facets, one or more holographic features or one or more surface features that are configured to form one or more lenses, one or more diffraction gratings, one or more focusing elements, one or more collimating elements, one or more diffusing elements, etc. As discussed above, the feature size of the microstructures can be greater than or equal to about 200.0 nm and less than or equal to about 2.0 mm. Accordingly, in various implementations, the individual microstructures may not be visible to the naked eye. However, the visual appearance of the regions 101*a*, 102*a* and 103*a* could be altered due to the presence of the microstructures. For example, if the microstructures in a region of the optical sheet 100 or 150 are configured as lenses (e.g. a Fresnel lens) then that region could have a lens like appearance. As another example, if the microstructures in a region of the optical sheet 100 or 150 are configured as diffracting elements then that region could appear multicolored or rainbow colored.

As discussed above, the microstructures in the plurality of regions (e.g., 101*a*, 102*a*, 103*a*) of the optical sheet 100 or 150 could be configured to produce different optical effects. For example, the microstructures in the plurality of regions (e.g., 101*a*, 102*a*, 103*a*) could be configured to change the shape of an incident light to create different far-field radiation patterns (e.g., spot light, flood light, task light, wash light, diffused light, etc.). In various implementations, the microstructures in each of the plurality of regions (e.g., 101*a*, 102*a*, 103*a*) can cooperate to produce a single far-field radiation pattern. In some implementations, the microstructures in each of the plurality of regions (e.g., 101*a*, 102*a*, 103*a*) can produce different far-field patterns. For example, the microstructures in the region 101*a* can be configured to produce a spot light, while the microstructures in the region 102*a* can be configured to produce a flood light.

As discussed above, the dimension (e.g., a height, a width, a breadth, a depth, a surface area) the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters is configured not to affect the far-field radiation pattern. For example, when the optical sheet 100 or 150 is disposed forward of a source of illumination in an illumination system or a luminaire, the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters may be visible to the naked eye when the illumination system or the luminaire is viewed directly for example by a person's eye peering at the optical sheet but the text, one or more letters (e.g., 105*a*), one or more numbers (e.g., 105*b* and 105*c*), one or more symbols (e.g., 105*d*, 105*e*, 105*f*), one or more image, one or more picture, one or more logos (e.g., 105*g*, 105*h*), or one or more characters is not visible in the far-field radiation pattern generated by the illumination system or the luminaire on a surface (e.g., floor, wall, ceiling, desk, table, etc.).

Figure 2A:
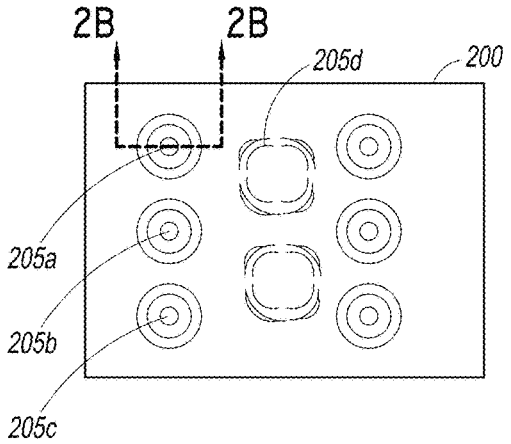
FIG. 2A illustrates an embodiment of an optical sheet comprising a plurality of optical elements.

FIG. 2A illustrates an embodiment of an optical sheet 200 comprising a plurality of optical elements (e.g., 205*a*, 205*b*, 205*c* and 205*d*). The plurality of optical elements (e.g., 205*a*, 205*b*, 205*c* and 205*d*) can be arranged periodically to form an array. Alternately, the plurality of optical elements (e.g., 205*a*, 205*b*, 205*c* and 205*d*) can be arranged randomly. In other implementations, the plurality of optical elements (e.g., 205*a*, 205*b*, 205*c* and 205*d*) can be arranged quasi-periodically such that the periodicity varies across the surface of the optical sheet. In various implementations, the plurality of optical elements (e.g., 205*a*, 205*b*, 205*c* and 205*d*) can be arranged to form a known pattern (e.g., a triangle, square, rectangle, rhombus, parallelogram, trapezoid, pentagon, hexagon, octagon, decagon, a star, a circular shape, an elliptical shape, a tear drop shape, an oval shape, a flower shape, a clover leaf shape, a character, a letter, a number, a symbol, a logo, etc.). In various implementations, the border of a pattern formed by plurality optical elements (e.g., 205*a*, 205*b*, 205*c* and 205*d*) can be configured to form text, a letter, a number, a symbol, an image, a picture, a logo, or a character having a dimension (e.g., a length, a width, a breadth, a height, a depth, a surface area) that is about 0.01% to about 50% of the corresponding dimension of the surface area of the pattern, as shown in FIGS. 1A and 1B. In various implementations, the border of one of the optical elements (e.g., 205*a*, 205*b*, 205*c* or 205*d*) can be configured to form text, a letter, a number, a symbol, an image, a picture, a logo, or a character.

In various implementations, some of the plurality of optical elements (e.g., 205*a*, 205*b*, 205*c* and 205*d*) can have a dimension sufficiently small (e.g., less than or equal to 1 mm) such that it cannot be perceived or resolved by the naked eye. In various implementations, some of the plurality of optical elements (e.g., 205*a*, 205*b*, 205*c* and 205*d*) can have a dimension between about 1 mm and about 50 mm. The plurality of optical elements (e.g., 205*a*, 205*b*, 205*c* and 205*d*) can be one or more of refractive elements (e.g. lenses, micro-lenses, lenslets, arrays of spherical or cylindrical lenses, etc., diffractive elements (e.g., gratings), diffusing elements, scattering elements, light redistributing elements, light reflecting elements, holographic elements, etc.

Each of the plurality of optical elements (e.g., 205*a*, 205*b*, 205*c* and 205*d*) can include a plurality of microstructures (e.g., linear or non-linear grooves, linear or curvilinear facets, holographic features, etc.) that produce a desired optical effect (e.g., refraction, diffraction, diffusion, scattering, collimation or focusing). The plurality of microstructures can include surface relief microstructures that are disposed on a surface of the optical sheet 200. The microstructures can have a feature size greater than or equal to about 200.0 nm and less than or equal to about 2.0 mm. For example, in various implementations, the feature size of the microstructures can be greater than or equal to about 200.0 nm and less than or equal to about 500 nm, greater than or equal to about 500 nm and less than or equal to about 1 μm, greater than or equal to about 1 μm and less than or equal to about 100 μm, greater than or equal to about 100 μm and less than or equal to about 500 μm, greater than or equal to about 500 μm and less than or equal to about 1 mm or greater than or equal to about 1 mm and less than or equal to about 2 mm. In various implementations, the microstructures can have a feature size sufficiently small such that they are not resolved by the naked eye.

In various implementations, each of the plurality of optical elements (e.g., 205*a*-205*d*) included in the optical sheet 200 can be a Fresnel lenses (e.g., a curved facet Fresnel lens, a flat facet Fresnel lens, a positive Fresnel lens, a negative Fresnel lens, etc). In various implementations, the Fresnel lenses can be similar to the Fresnel described in U.S. Pat. No. 7,298,533 (WVFRNT.003A), which is incorporated herein in its entirety. Each optical element configured as a Fresnel lens (as seen for example from a front view) include a plurality of grooves (e.g., circular, linear or elliptical arcs) disposed about an optical axis of the optical element. Without any loss of generality, the optical axis of the optical element can be perpendicular to the optical sheet 200. In various implementations, the plurality of grooves include arcs. In such implementations, each of the plurality of arcs has a center of curvature. In such implementations, the plurality of arcs could be concentric such that they have a common center of curvature. Alternately the plurality of arcs need not be concentric. In various implementations, some or all of the plurality of arcs can have an angle less than 360 degrees.

In various implementations, each of the plurality of arcs could form an annular structure, as depicted by optical elements 205*a*-205*d*. In various implementations, some of the plurality of arcs can be segmented.

Figures 1, 2B:
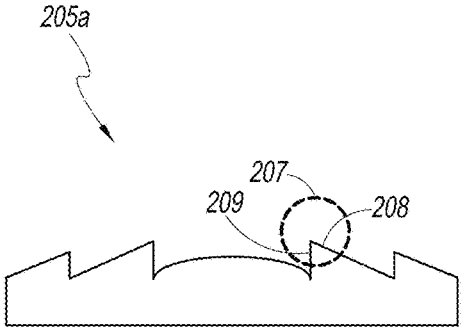
FIGS. 2B-1 and 2B-2 illustrate a cross-section of an optical element illustrated in FIG. 2A.
Figures 2, 2B:
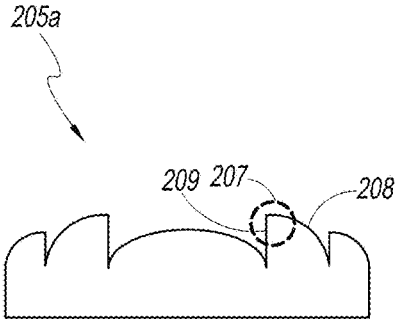

FIGS. 2B-1 and 2B-2 illustrate a cross-sectional view along the axis A-A' of the optical element 205*a* configured as a positive Fresnel lens. Each groove of the optical element 205*a* includes a pair of facets 208 and 209 arranged to form a prismatic feature (e.g., 207). In various implementations, the pair of facets 208 and 209 can be linear, as shown in FIG. 2B-1 or curvilinear, as shown in FIG. 2B-2. As discussed above, each optical element 205*a*-205*d* configured as a Fresnel lens can have a size sufficiently small (e.g., a width between 5 microns about a few hundred microns) such that each optical element 205*a*-205*d* is not resolved by the naked eye without the aid of a magnifying optical element. In various implementations, each optical element 205*a*-205*d* configured as a Fresnel lens can have a size between about 0.1 mm and about 50 mm. For example, in various implementations, each optical element 205*a*-205*d* can have a size between about 0.1 mm and about 10 mm, between about 10 mm and about 20 mm, between about 20 mm and about 30 mm, between about 30 mm and about 40 mm or between 40 mm and about 50 mm. Furthermore, as discussed above, the plurality of linear or curvilinear facets can have a size sufficiently small (e.g., greater than or equal to 20 nm and less than or equal to 2 mm) such that the facets are not resolved by the naked eye.

Figure 2C:
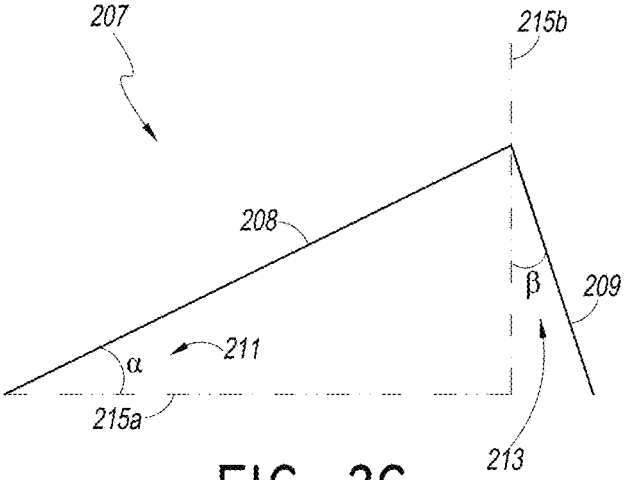
FIG. 2C shows a detailed view of a prismatic section of the optical element.

FIG. 2C shows a detailed view of the prismatic section 207 of the optical element 205*a*. Each prismatic section 207 includes a primary optical facet 208 that has a shallow slope and a secondary optical facet 209 that has a steep slope. Without any loss of generality, the secondary optical facet 209 has reduced interaction with light incident on the optical sheet 200 as compared to the primary optical facet 208. The primary optical facet 208 forms a primary optical facet angle, α, 211, with respect to an axis 215*a* along the surface of the optical sheet 200 and the secondary facet 209 forms a secondary facet angle, β, 213 with respect to an axis 215*b* perpendicular to the optical sheet 200. The primary optical facet angle, a, 211, and the secondary facet angle, β, 213 are both less than 90 degrees.

For a standard Fresnel lens including a plurality of circular arcs, the primary optical facet angle, α, 211, varies monotonically with respect to the distance of the facet from the center of curvature of the arc (or varies monotonically with respect to the radius of curvature of the arc). For a standard Fresnel lens, the variation of the primary optical facet angle, α, 211, can be monotonically increasing or decreasing with respect to the radius of curvature of the arc. In various implementations of a standard Fresnel lens, the primary optical facet angle, α, 211 can vary quadratically or parabolically with respect to the radius of curvature of the arc, as indicated by curve 305 in FIGS. 3A and 3B. In various implementations of a standard Fresnel lens, the primary optical facet angle, α, 211 can vary as a polynomial function (e.g., Bessel or Zernike polynomial function) with respect to the radius of curvature of the arc, as indicated by curve 305 in FIGS. 3A and 3B.

Figure 3A:
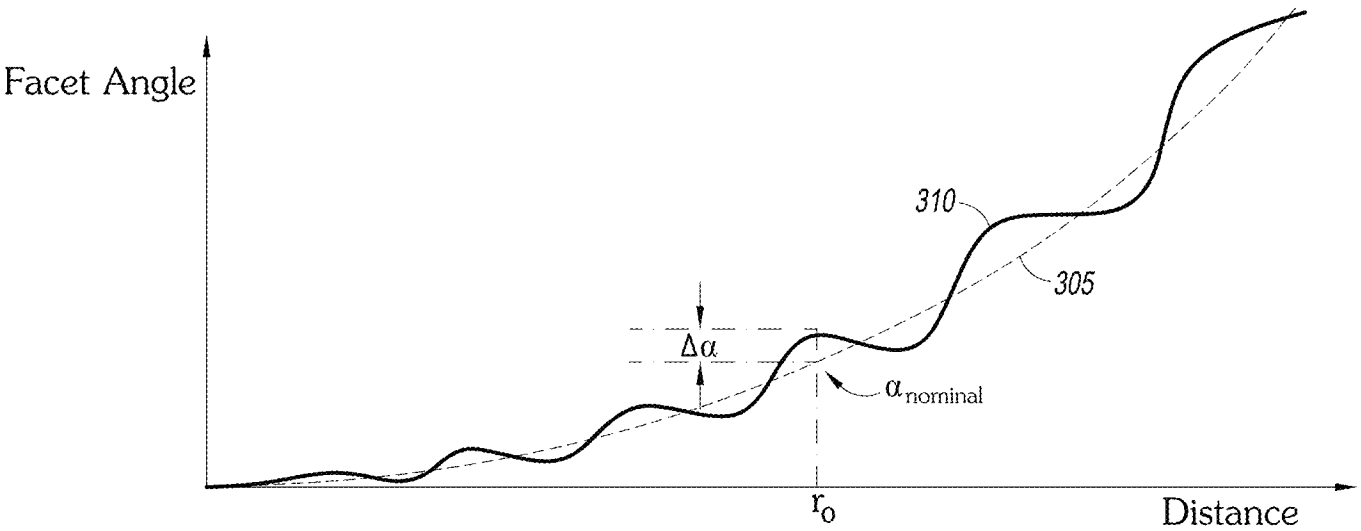
FIGS. 3A and 3B illustrate the variation of the facet angle with respect to a radius for the facets included in the optical element.
Figure 3B:
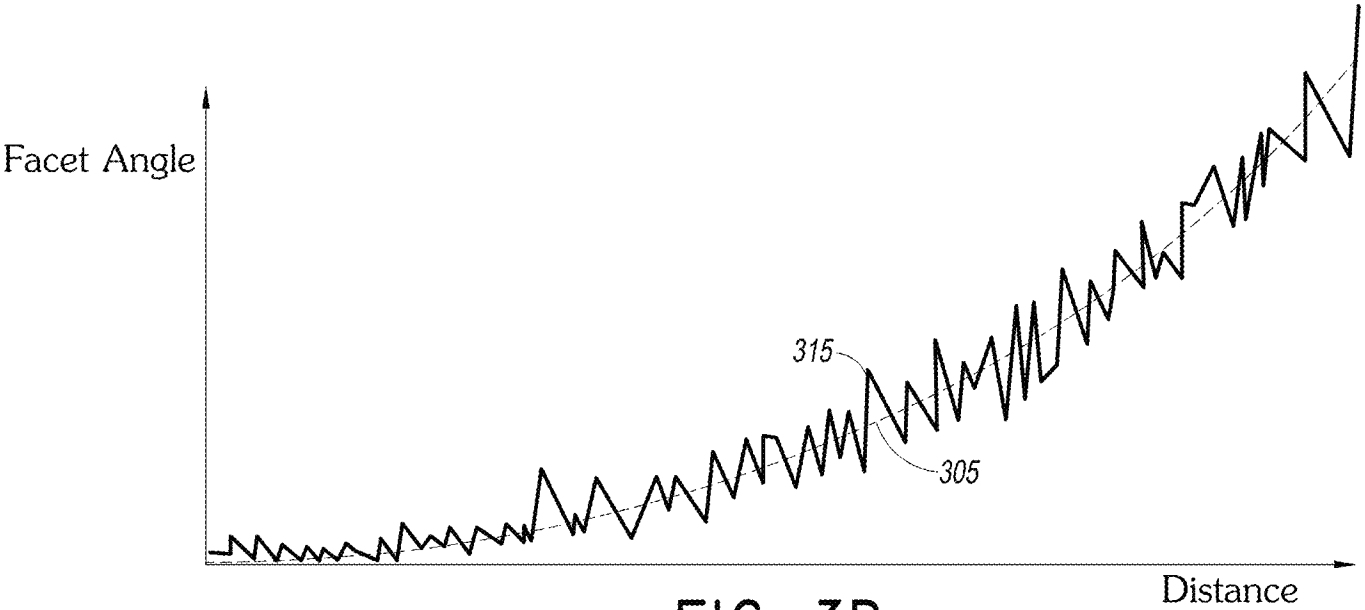

In various implementations of the optical sheet 200 described herein, the primary facet angle, $\alpha$, of a groove disposed at a distance $r_0$ from the optical axis can deviate from a nominal value $\alpha_{nominal}$ determined by the monotonic function by an amount $\Delta\alpha$, as shown in FIG. 3A. In implementations of an optical element including concentric circular arcs, the optical axis can coincide with the center of curvature of the arcs and the distance of the groove from the optical axis can coincide with a radial distance of the arc from the center of curvature of the arc. In various implementations, the amount of variation of the primary facet angle, a, from the nominal value $\alpha_{nominal}$ can be determined by an undulating curve such as a sinusoidal curve 310 superimposed on the monotonic curve 305, as shown in FIG. 3A or a randomly varying curve 315 superimposed on the monotonic curve 305, as shown in FIG. 3B. Accordingly, in various implementations of the optical sheet 200 described herein, the primary facet angle $\alpha$ for a facet of a groove disposed at a distance $r_0$ from the optical axis can be expressed mathematically as $\alpha_{nominal}\pm\Delta\alpha$. In various implementations, the amount of deviation $\Delta\alpha$ from the nominal value $\alpha_{nominal}$ can vary between about 10% to about 500% of the nominal value $\alpha_{nominal}$ at a particular distance $r_0$ from the optical axis. For example, the amount of deviation of $\Delta\alpha$ from the nominal value $\alpha_{nominal}$ can vary between about 10% to about 25%, about 25% to about 50%, about 50% to about 75%, about 100% to about 125%, about 125% to about 150%, about 150% to about 200%, about 200% to about 300%, about 300% to about 400% or about 400% or about 500% of the nominal value $\alpha_{nominal}$ at a particular distance $r_0$ from the optical axis. In various implementations, the amount of deviation $\Delta\alpha$ can have a maximum absolute value between about 15 degrees and about 30 degrees, between about 20 degrees and about 25 degrees or angles there between. In various implementations, the primary facet angle $\alpha$ at a particular distance $r_0$ from the optical axis can have a value between about ($\alpha_{nominal}$−25) degrees and about ($\alpha_{nominal}$+25) degrees, where $\alpha_{nominal}$ is the value of the monotonic curve 305 at the distance $r_0$ from the optical axis.

In various implementations, the undulating curve (e.g., 310) can be periodic or quasi-period. In various implementations, the periodicity of the undulating curve (e.g., 310) can vary monotonically (e.g., increasing or decreasing) with distance of the groove from the optical axis. In various implementations, the amplitude of the undulating curve (e.g., 310) can be constant or increase or decrease randomly or in accordance with some mathematical function.

Implementations of the optical sheet 200 including a plurality of Fresnel lenses whose facet angle $\alpha$ deviates from the nominal angle $\alpha_{nominal}$ as discussed above can produce interesting or unique visual effects such that the optical sheet 200 has a visual appearance different from an optical sheet comprising standard Fresnel lenses without these design features. For example, in various implementations, the plurality of grooves can appear as sections of a sphere, a toroid or a conic by changing the primary facet angle $\alpha$ as discussed above with reference to FIGS. 3A and 3B. The visual appearance of the implementations of the optical sheet 200 including a plurality of Fresnel lenses whose facet angle $\alpha$ deviates from the nominal angle $\alpha_{nominal}$ as discussed above can appear frosted, rippled, shiny, flashing, multicolored, brighter in the center, brighter at the edges, sparkling, wavy, shimmering, beaded, etc.

Figure 3C:
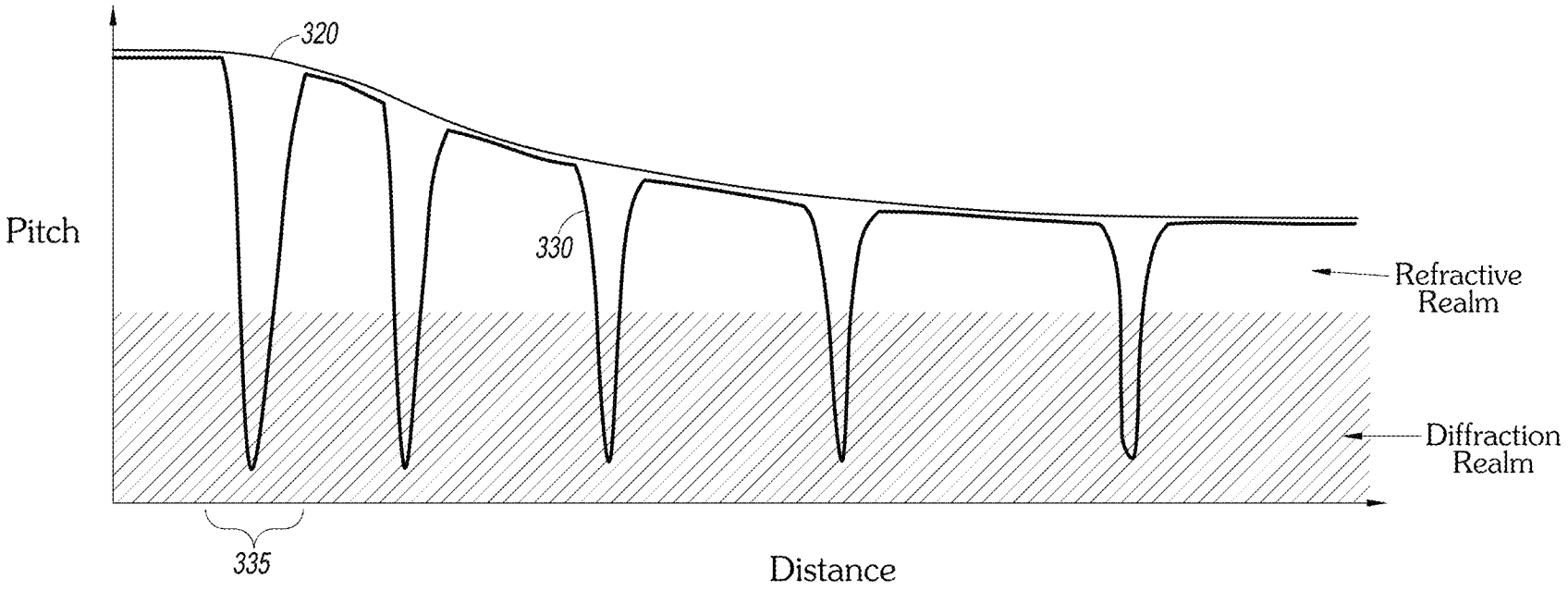
FIG. 3C illustrates the variation of the pitch or the distance between two consecutive facets with respect to a radius for an implementation of an optical element configured as a Fresnel lens.

The variation of the distance between two consecutive primary optical facets included in consecutive arcs (also referred to as a pitch) with respect to the radius of curvature of the arc for a standard Fresnel lens is shown by curve 320 in FIG. 3C. In various implementations of standard Fresnel lenses, the pitch can vary from a large value near the center of the optical element to a small value near the edge of the optical element. In some implementations, the variation of the pitch with respect to the distance from the optical axis can be a monotonically increasing or decreasing function.

In various implementations of the optical sheet 200 described herein, the pitch can vary with respect to the distance from the optical axis as shown by curve 330 having a plurality of peaks and valleys. In various implementations, the distance between consecutive peaks and valleys in the curve 330 can be periodic. In various implementations, the distance between consecutive peaks and valleys in the curve 330 can be quasi-periodic wherein the periodicity varies with distance from the optical axis. In some implementations, the distance between consecutive peaks and valleys in the curve 330 can vary randomly. In various implementations, the pitch between two consecutive primary optical facets can vary between a distance equal to a fraction of the wavelength of light in the visible spectral range (e.g., 450 nm-750 nm) and about 1 mm. In such implementations, the primary optical facets having a pitch below or on the order of a wavelength of light in the visible spectral range (e.g., 450 nm-750 nm) function as primarily as diffractive elements and the primary optical facets having a pitch greater than an order of magnitude of the wavelength of light in the visible spectral range (e.g., 450 nm-750 nm) function as primarily as refractive elements.

Figure 3D:
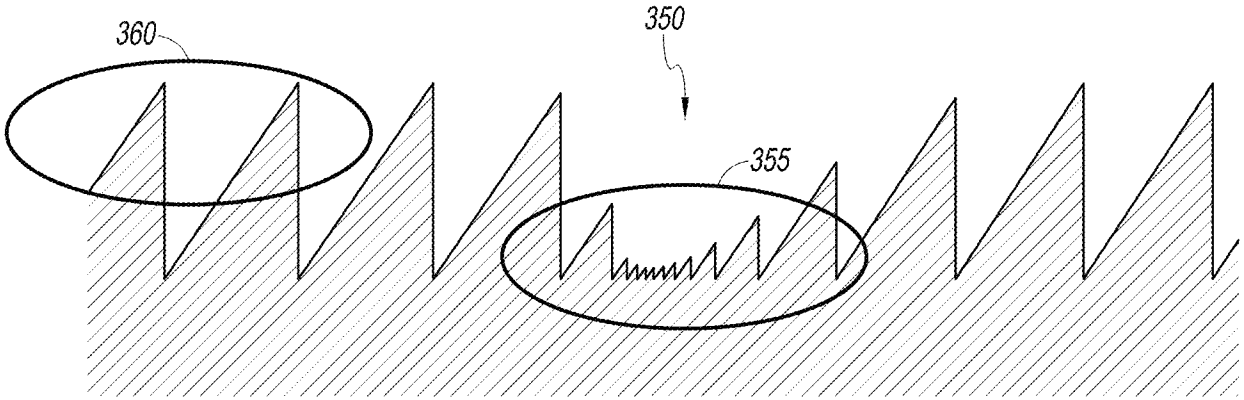
FIG. 3D illustrates the cross-sectional view of a portion of an optical element configured as a Fresnel lens including facets whose pitch varies as shown in FIG. 3C.

FIG. 3D illustrates the cross-sectional view of a portion of an optical element 350 configured as a Fresnel lens including facets whose pitch varies as shown in FIG. 3C. The pitch of the primary optical facets in the region 355 varies between about 200 nm to about 1 micron such that the facets in the region 355 function as diffractive elements. The pitch of the primary optical facets in the region 360 is greater than about 1 micron such that the facets in the region 360 function as refractive elements. An implementation of an optical sheet 200 including the optical element 350 can appeared multicolored or rainbow colored due to the diffractive effects produced by the facets in the region 355 which function as diffractive elements.

Figure 4A:
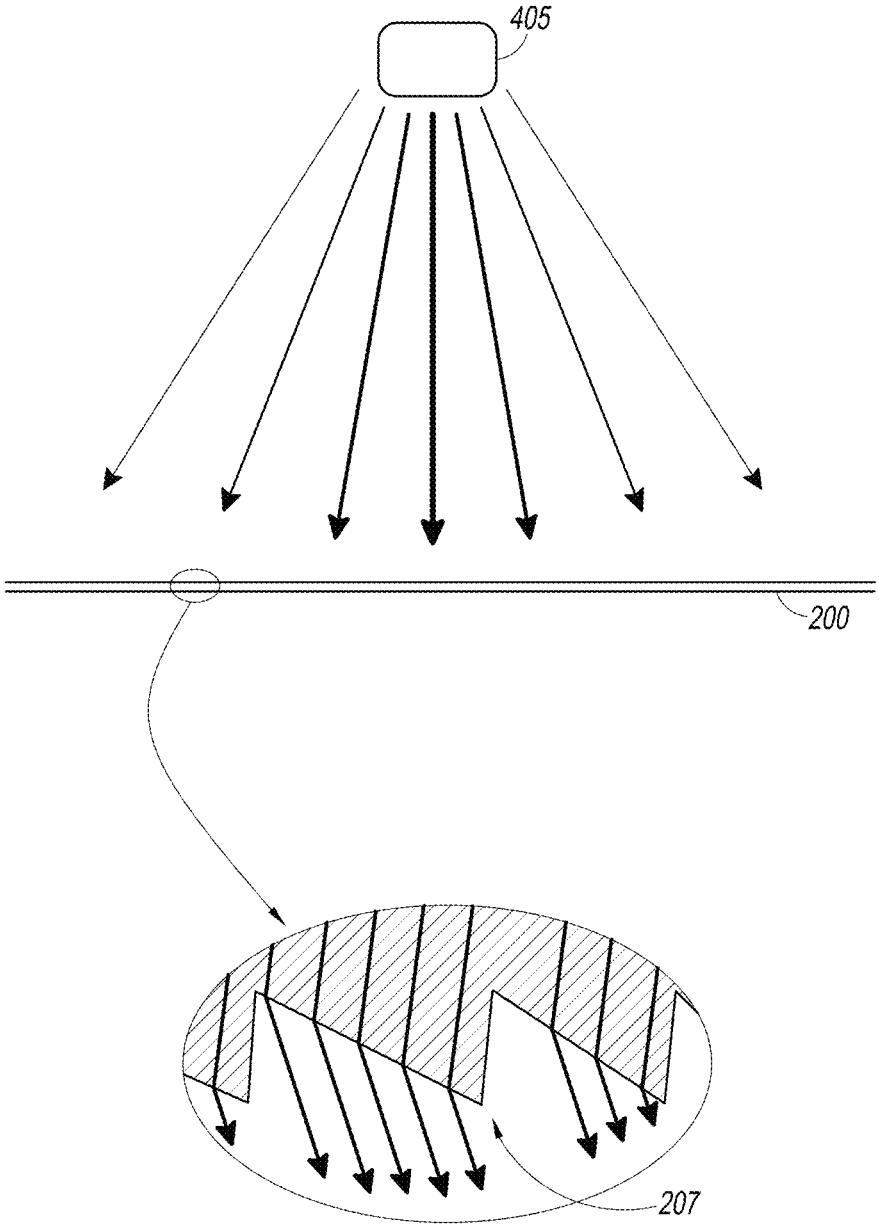
FIG. 4A shows an embodiment of an optical sheet comprising a plurality of optical elements, each optical element including a plurality of facets positioned in front of a source of illumination.
Figure 4B:
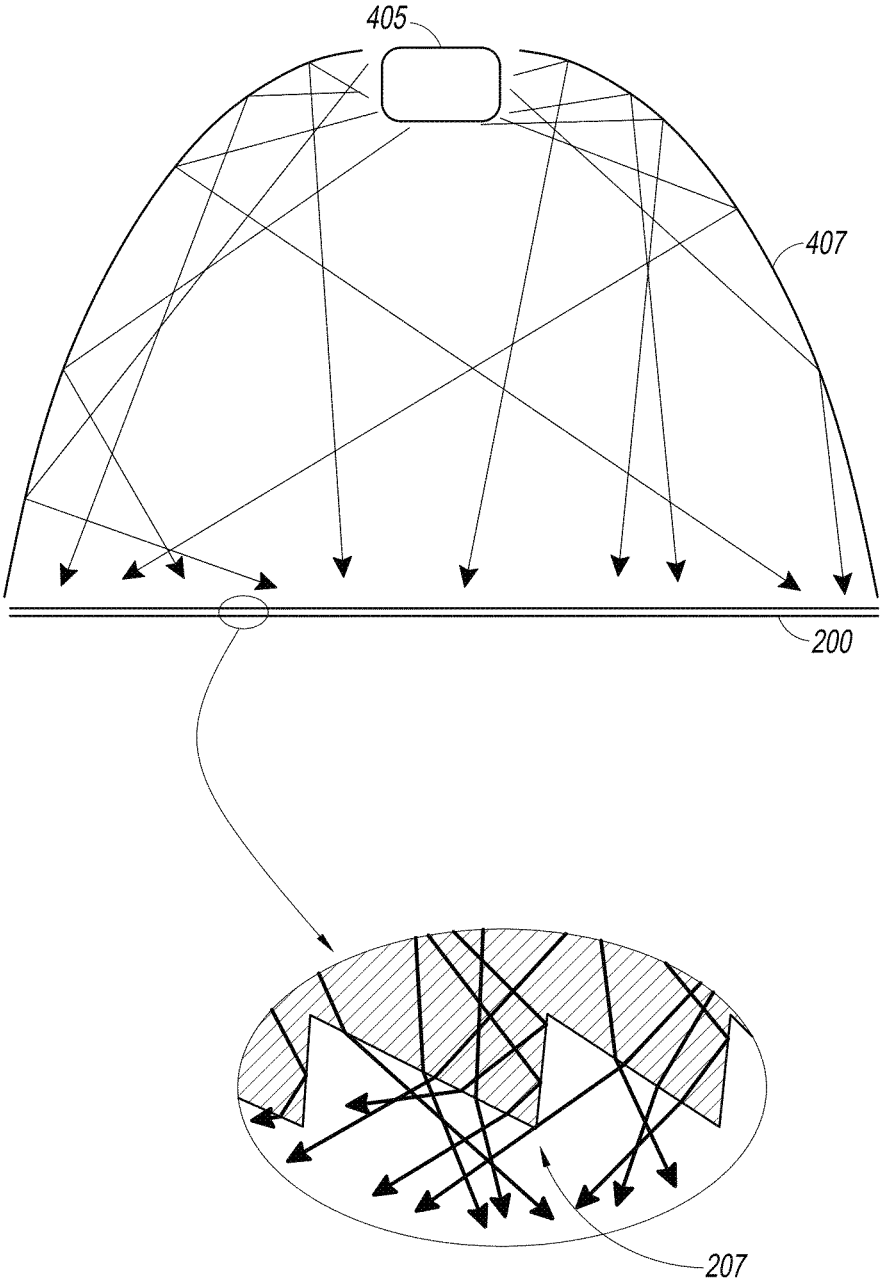
FIG. 4B illustrates an embodiment of an optical sheet comprising a plurality of optical elements, each optical element including a plurality of facets positioned in front of an illumination system including a source of illumination and a diffuser.

The optical sheet 200 including a plurality of optical elements configured as Fresnel lenses can be positioned forward of a source of illumination 405 as shown in FIG. 4A. In various implementations, the optical sheet 200 can be positioned such that the plurality of optical elements are on a side opposite the side of the source of illumination 405. In various implementations, the optical sheet 200 can be positioned such that the plurality of optical elements are on a same side as the side of the source of illumination 405. Light rays from the source of illumination can be redirected out of the optical sheet 200 by the primary optical facets (e.g., facet 208) of the Fresnel lenses to achieve different radiation patterns (e.g., focused beam, collimated beam, dispersed beam, etc.). Due to the position of the illumination source 405 with respect to the optical sheet 200 and the direction of the slope of the secondary optical facets (e.g., facet 209), the secondary optical facets can have reduce or no interaction with rays of light incident on the optical sheet 200.

In various implementations, a diffuse reflector 407 can be disposed around the source of illumination 405. In various implementations, the diffuse reflector 407 can be a Lambertian diffuser. In various implementations, the diffuse reflector 407 can include materials manufactured and sold by WhiteOptics, LLC. In such implementations, light from the light source 405 that are emitted in oblique directions can be reflected by the diffuse reflector 407 such that they are redirected by the secondary optical facet 209 out of the optical sheet 200. However, in such implementations, the angle along which light is ejected out of the optical sheet after interaction with the secondary optical facet 209 is random.

Figure 5A:
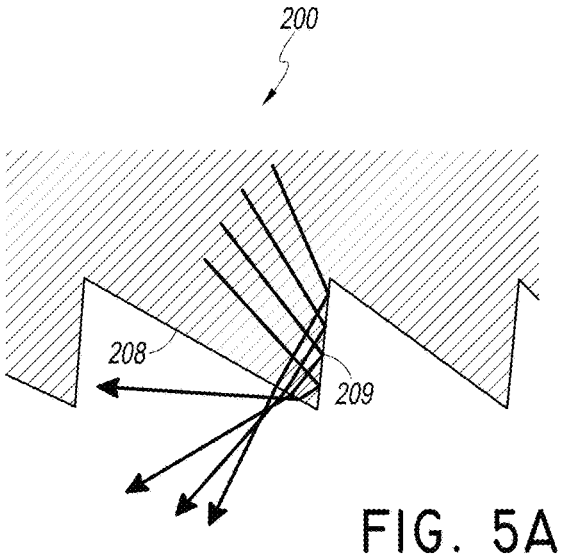
FIGS. 5A, 5B and 5C illustrate different implementations of the facets included in the optical sheet included in the embodiment illustrated in FIG. 4B.
Figure 5B:
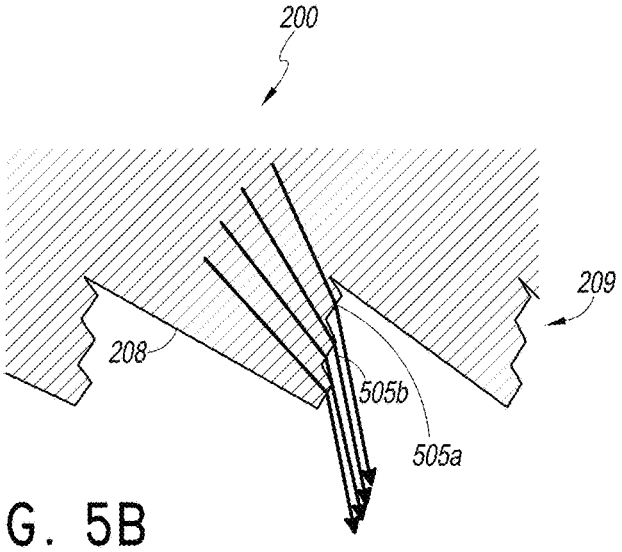

For example, as seen from FIG. 5A, light reflected from the diffuse reflector 407 can be redirected by the secondary optical facet 209 out of the optical sheet 200 in directions different from the direction along which light is redirected by the primary optical facet 208.

The direction along which light is ejected out of the optical sheet 200 after interaction with the secondary optical facet 209 can be controlled by varying the secondary optical facet angle β. For example, in various implementations, the secondary optical facet angle β can be configured such that light is ejected out of the optical sheet 200 after interaction with the secondary optical facet 209 along a desired direction (e.g., same as the direction along which light is redirected by the primary optical facet 208, generally perpendicular to the optical sheet 200, at an oblique angle with respect to the optical sheet 200, in a downward direction with respect to the sheet, etc.). In various implementations, the secondary optical facet 209 can include a plurality of prismatic features (e.g., 505*a*, 505*b*) that are configured to redirect light reflected by the diffuse reflector 407 along a desired direction (e.g., same as the direction along which light is redirected by the primary optical facet 208, generally perpendicular to the optical sheet 200, at an oblique angle with respect to the optical sheet 200, etc.). In various implementations, the size of the prismatic features (e.g., 505*a*, 505*b*) included on the secondary optical facet 209 can be between 200 nm and about 15 μm. Such implementations can advantageously be used to generate different radiation patterns. In various implementations, the prismatic features can be refractive features and/or reflective (e.g., total internal reflection) features that operate on the incident light by refraction, total internal reflection, or both.

Figure 5C:
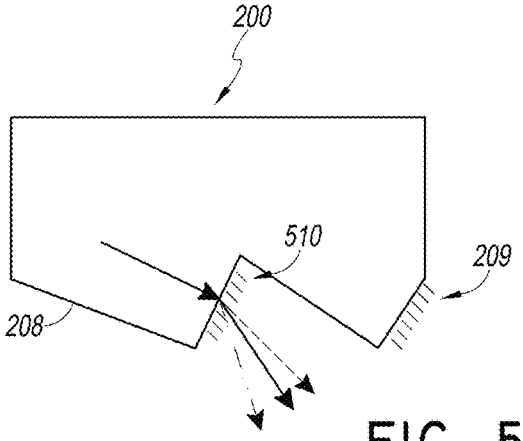

In various implementations, the second optical facet 209 can include a plurality of diffractive features 510, as shown in FIG. 5C, such that incident white light can be diffracted into a plurality of different wavelengths directed in different directions to create a rainbow effect. In various implementations, the diffractive features 510 can have a between about 200 nm and about 2 μm. Such implementations of optical sheets can be used to increase the aesthetic or visual appeal of the optical sheet 200.

Various implementations of the optical sheet 100, 150 or 200 can be substantially transmissive or comprise a reflective surface. For example, a layer of metallization or a thin film dielectric stacked structure may be provided in portions of the optical sheet 100, 150 or 200. Various implementations of the optical sheet 100, 150 or 200 can include a material having color or a film such as a dielectric film that imparts color or tint to the optical sheet 100, 150 or 200. The optical sheet 100, 150 or 200 may comprise a flexible or rigid substrate such as for example paper, polyester (PET), polycarbonate (PC), polypropylene (PPOP), acrylic, and glass. Other materials may be used as well. In certain embodiments, a layer such as a polymer layer may be formed on the substrate and the microstructures may be imprinted on this polymer layer. This polymer layer may be cured, for example, by UV curing, heating, exposure to e-beam or using other techniques.

The microstructures included in optical sheet 100, 150 or 200 can be manufactured according to a wide variety of techniques. For example, individual dies for Fresnel lenses or diffractive or holographic optical elements can be formed by diamond turning or photomask techniques. Larger patterns may be formed by step and repeat processes. Still larger lens patterns may be embossed onto rolls of film to create the optical sheets 100, 150 or 200. Various other methods of forming the microstructures, described in U.S. Pat. No. 7,298,533 (WVFRNT.003A), which is incorporated by reference herein in its entirety, can also be used. Still other configurations are possible and should not be limited to those described herein.

Figure 6:
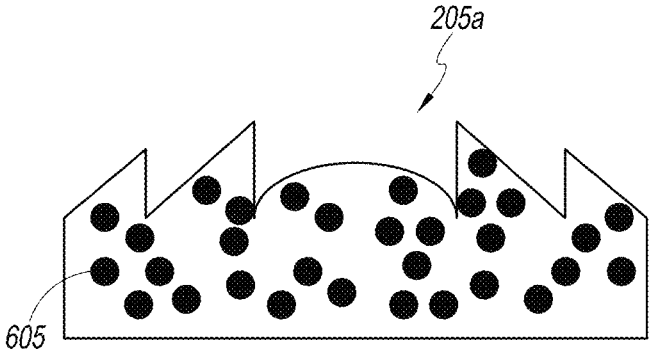
FIG. 6 illustrates an implementation of an optical sheet including a plurality of microstructures and nano-particles.

FIG. 6 illustrates an implementation of an optical sheet 600 including a plurality of optical elements (e.g., 205*a*-205*d*) and a plurality of nano-particles 605 incorporated in the material of the optical sheet 200. In various implementations, the nano-particles 605 can be transmissive. In various implementations, the nano-particles 605 can be opaque. In various implementations, the nano-particles can include materials sold by Nanostructured & Amorphous Materials, Inc. The nano-particles 605 can comprise elements and alloys (e.g., Ag, Al, Au, Activated Carbon, Diamond, Graphite, Co, Cr, Cu, Fe, Mo, Ni, Pd, Pt, Ru, Si, Ta, Ti, W or Zn); compounds (e.g., AlN, BN, SiC, $Si_3N_4$, $TiB_2$, TiC, TiN, WC/Co or ZrC); oxides (e.g., $A_{12}O_3$, $Al(OH)_3$, $B_2O_3$, $Bi_2O_3$, $CeO_2$, $Co_3O_4$, $Cr_2O_3$, CuO, $Dy_2O_3$, $Er_2O_3$, $Eu_2O_3$, $Fe_2O_3$, $Fe_3O_4$, $Gd_2O_3$, $HfO_2$, $In_2O_3$, $In(OH)_3$, $La_2O_3$, MgO, $Mg(OH)_2$, $MoO_3$, $Nd_2O_3$, $Pr_6O_{11}$, $SiO_2$, $Sm_2O_3$, $SnO_2$, $Tb_4O_7$, $TiO_2$, $WO_3$, $Y_2O_3$, ZnO, $ZrO_2$, $BaFe_{12}O_{19}$, $BaSO_4$, $BaTiO_3$,99.8%, $CoFe_2O_4$, $Co_{0.5}Zn_{0.5}Fe_2O_4$, $In_2O_3$:$SnO_2$, $La_{0.15}Sr_{0.85}MnO_3$, $NiFe_2O_4$, $Ni_{0.5}Zn_{0.5}Fe_2O_4$, $SrA_{112}O_{19}$, $Y_3A_{15}O_{12}$, $ZnFe_2O_4$, $ZnOA_{12}O_3$ (AZO)), carbon nano-particles, organic materials (e.g., Urethane, acrylic, polycarbonate, etc.). In various implementations, each of the nano-particles 605 can have a size between about 5 nm and about 8 μm. In various implementations, the nano-particles can have a size substantially equal to the size of quantum dots. The nano-particles 605 can be uniformly or randomly distributed in the volume of the optical sheet 200. The nano-particles 605 can be distributed pseudo-randomly or partially randomly as well. In various implementations, each of the plurality of optical elements (e.g., 205*a*-205*d*) can include a plurality of microstructures that are configured as refractive elements, diffractive elements, scattering elements, dispersive elements, diffusing elements, etc. In some implementations, the plurality of microstructures can include facets that are configured such that some of the plurality of optical elements are configured as a Fresnel lens. In some implementations, the nano-particles 605 can alter (e.g., increase or decrease) the refractive index of the material of the optical sheet 200 such that the optical sheet has a unique and/or interesting visual appearance. For example, the plurality of nano-particles 605 can cause scintillation effects when light from a light source is incident on such an implementation of the optical sheet 200. As another example, the plurality of nano-particles 605 can cause diffusing effects.

Such optical sheets can be manufactured by incorporating a plurality of nano-particles 605 in a matrix of an optical material having a refractive index. The optical material can be in a liquid state or a gel state. The nano-particles 605 can be distributed uniformly or randomly through the matrix. Microstructures can be formed on a surface of the matrix and the matrix can be cured (e.g., by heating, UV curing or some other method).

Figure 7:
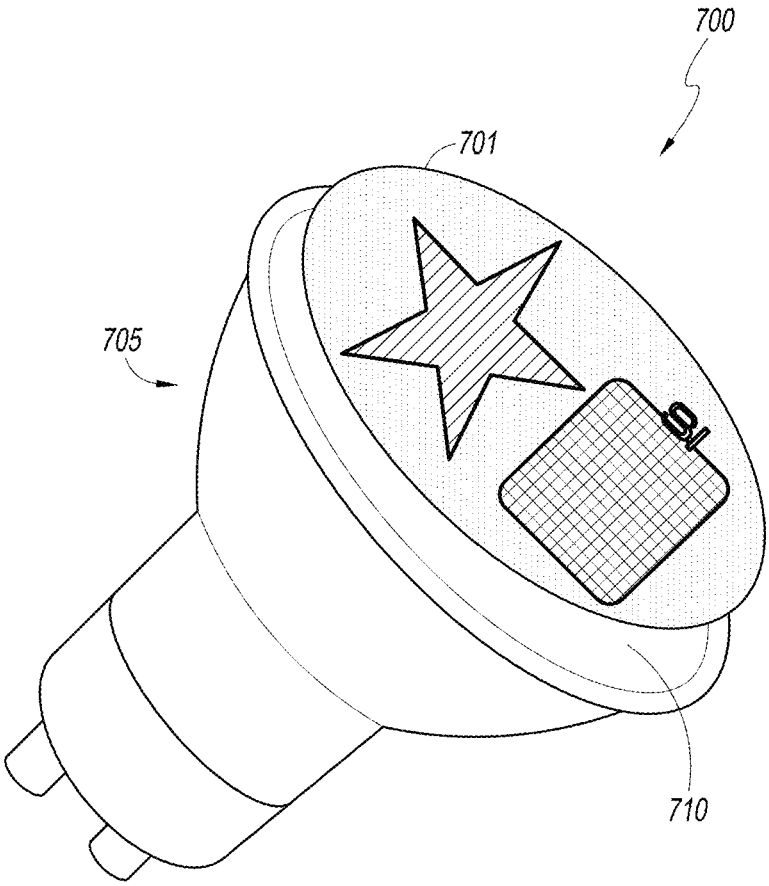
FIG. 7 illustrates an implementation of an illumination system including a microstructured optical sheet.

FIG. 7 illustrates an illumination system 700 including a light fixture 705, a source of illumination 710 and an optical sheet 701 disposed forward of the source of illumination

710. The optical sheet 701 can be optically transparent or transmissive. In various implementations, the optical sheet 701 can be similar to the optical sheets 100, 150, 200 and 600 disclosed above. The optical sheet 701 can include a matrix of an optical material having a refractive index. The optical sheet 701 can have a thickness between about 0.01 mm and about 10 mm. As discussed above, the optical sheet 701 can include one or more regions including one or more optical elements. The one or more optical element can include refractive elements (e.g. lenses, micro-lenses, lenslets, arrays of spherical or cylindrical lenses, Fresnel lenses, etc.), prismatic elements with planar or curved facets, diffractive elements (e.g., gratings, holographic optical elements), diffusing elements, scattering elements, light redistributing elements, light reflecting elements, etc. Each of the one or more optical elements can include a plurality of microstructures (e.g., planar or curved facets, linear or non-linear grooves, holographic features, surface relief microstructures, etc.). The one or more optical elements in the optical sheet 701 can alter the radiation of light output from the illumination source 710. Accordingly, the optical sheet 701 can be used to tailor the direction and/or the radiation pattern of light output from the illumination source 710 for various residential and commercial lighting applications. In various implementations, the optical sheet 701 can be used to change at least one of a direction, a size or an angular width of the incident beam. For example, the optical sheet 701 can be configured to tailor the light output from the illumination source 710 as a spot light, a focused beam, a diffused beam, a collimated beam, a flood light, a wash light, etc.

Figure 8:
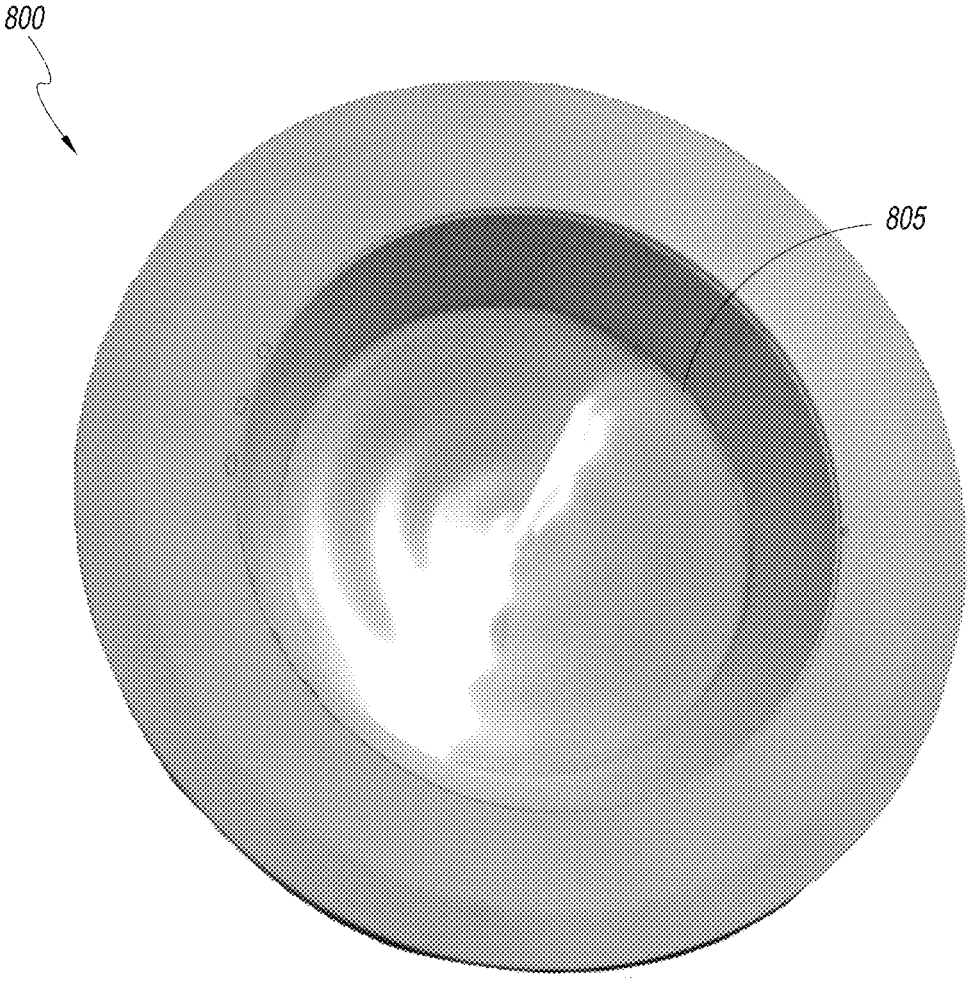
FIG. 8 is a photograph illustrating the visual appearance of an illumination system including a microstructured optical sheet.

In various implements, the feature size of the plurality of microstructures forming the one or more optical elements included in the optical sheet 701 can have a feature size between about 200.0 nm and about 2.0 mm, such that some of the microstructures are not resolved by the naked human eye without the aid of a magnifying optical element. Although, the plurality of microstructures may not be resolved by the naked human eye, they plurality of microstructures could impart a texture to the optical sheet 701. In addition to tailoring the radiation pattern of the light output from the illumination source 710, the microstructures can also be configured to impart unique and interesting visual qualities to the optical sheet 701 such that the optical sheet visually appears different from standard lenticular or prismatic sheets when viewed by the naked human from a distance (e.g., a distance between about 6 inches and about 15 feet). For example, the optical sheet 701 can appear frosted, rippled (as shown in FIG. 8), shiny, flashing, multicolored, brighter in the center, brighter at the edges, sparkling, wavy, shimmering, beaded, etc. In various embodiments, the optical sheet can have an appearance that is different from a lens, a lenticular sheet or a prismatic sheet.

In various implementations, the one or more regions can include a central portion and a border, the border of the one or more regions can be configured to form at least one of text, a letter, a number, a symbol, an image, a picture, a logo, or a character. The text, the letter, the number, the symbol, the image, the picture, the logo, or the character has a size (or dimension) such that the text, the letter, the number, the symbol, the image, the picture, the logo, or the character may or may not be resolved by a naked human eye from a distance (e.g., a distance between about 6 inches and about 15 feet). In various implementations, the text, the letter, the number, the symbol, the image, the picture, the logo, or the character has a size (or dimension) that is between 0.01% and about 50% of a corresponding dimension of the central portion. In various implementations, the text, the letter, the number, the symbol, the image, the picture, the logo, or the character has a size (or dimension) such that it is not visible in the radiation pattern output from the illumination system 700.

In various implementations of the illumination system 700, the source of illumination 710 can include a plurality of light emitting diodes (LEDs), one or more concentrated incandescent source, one or more fluorescent bulbs. The various optical elements (e.g., 205*a*-250*d*) in the optical sheet 701 can be registered with the plurality of plurality of light emitting diodes (LEDs), one or more concentrated incandescent source, one or more fluorescent bulbs such that one or more of the optical elements (e.g., 205*a*-250*d*) are aligned with one or more of the plurality of light emitting diodes (LEDs), one or more concentrated incandescent source, one or more fluorescent bulbs included in the source of illumination 710.

In various implementations of the illumination system 700, the light fixture 705 can be configured as a fixed down light, a gimbal down light, a track light, etc. The light fixture 705 can include be generally circular or linear. In various implementations, the light fixture 705 can be recessed in openings in walls, ceilings or floors. In various implementations, the light fixture 705 can include electrical connections to connect the illumination system 700 to an AC or DC connection. In various implementations, the light fixture 705 can include openings to receive batteries to power the illumination source 710.

FIG. 8 illustrates an illumination system 800 including an optical sheet 805 similar to the optical sheet 200 or 600. The optical sheet 805 comprises a plurality of optical element (e.g., Fresnel lenses) including a plurality of microstructures (e.g., facets). As discussed above, the plurality of microstructures (e.g., facets) are configured to impart a rippled (like the surface of water) appearance to the illumination system 800 when directly viewed from a distance (e.g., a distance between about 6 inches and about 15 feet). As observed from FIG. 8, the illumination system 800 appears rippled like the surface of water. Such illumination systems can be used for decorative purposes.

References throughout this specification to "one embodiment," "an embodiment," "a related embodiment," or similar language mean that a particular feature, structure, or characteristic described in connection with the referred to "embodiment" is included in at least one embodiment of the present invention. Thus, appearances of the phrases "in one embodiment," "in an embodiment," and similar language throughout this specification may, but do not necessarily, all refer to the same embodiment. It is to be understood that no portion of disclosure, taken on its own and in possible connection with a figure, is intended to provide a complete description of all features of the invention.

In the drawings like numbers are used to represent the same or similar elements wherever possible. The depicted structural elements are generally not to scale, and certain components are enlarged relative to the other components for purposes of emphasis and understanding. It is to be understood that no single drawing is intended to support a complete description of all features of the invention. In other words, a given drawing is generally descriptive of only some, and generally not all, features of the invention. A given drawing and an associated portion of the disclosure containing a description referencing such drawing do not, generally, contain all elements of a particular view or all features that can be presented is this view, for purposes of simplifying the given drawing and discussion, and to direct the discussion to particular elements that are featured in this drawing. A skilled artisan will recognize that the invention may possibly be practiced without one or more of the specific features, elements, components, structures, details, or characteristics, or with the use of other methods, components, materials, and so forth. Therefore, although a particular detail of an embodiment of the invention may not be necessarily shown in each and every drawing describing such embodiment, the presence of this detail in the drawing may be implied unless the context of the description requires otherwise. In other instances, well known structures, details, materials, or operations may be not shown in a given drawing or described in detail to avoid obscuring aspects of an embodiment of the invention that are being discussed. Furthermore, the described single features, structures, or characteristics of the invention may be combined in any suitable manner in one or more further embodiments.

Moreover, if the schematic flow chart diagram is included, it is generally set forth as a logical flow-chart diagram. As such, the depicted order and labeled steps of the logical flow are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow-chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Without loss of generality, the order in which processing steps or particular methods occur may or may not strictly adhere to the order of the corresponding steps shown.

The features recited in claims appended to this disclosure are intended to be assessed in light of the disclosure as a whole.

As used herein, a phrase referring to "at least one of" a list of items refers to any combination of those items, including single members. As an example, "at least one of: a, b, or c" is intended to cover: a, b, c, a-b, a-c, b-c, and a-b-c.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. An optical sheet comprising:

a first region comprising one or more optical elements, at least one of the one or more optical elements including a plurality of microstructures, the one or more optical elements configured to alter a far-field radiation pattern of an incident beam, the first region including a central portion and a border configured to visually demarcate the first region from a surrounding area, wherein a portion of the border is configured to form at least one of text, a letter, a symbol, a number, an image, a picture or a character, and wherein a dimension of the text, the letter, the symbol, the number, the image, the picture or the character is between about 0.01 % and about 50 % of a corresponding dimension of the central portion such that the text, the letter, the symbol, the number, the image, the picture or the character is not resolved by a naked human eye without aid of magnification.

2. The optical sheet of claim 1, wherein at least one of the one or more optical elements includes a Fresnel lens.

3. The optical sheet of claim 1, wherein a section of the border forms a logo.

4. The optical sheet of claim 1, wherein the plurality of microstructures includes at least one of a planar facet, a curved facet, a linear groove, a curvilinear groove or a holographic feature.

5. The optical sheet of claim 1, wherein the surrounding area includes a second region comprising one or more optical elements, at least one of the one or more optical elements of the second region including a plurality of microstructures, the second region including a central portion and a border, wherein the second region is visually demarcated from the first region.

6. An illumination system comprising:

a source of illumination; and the optical sheet of claim 1 disposed forward of the source of illumination.

7. The optical sheet of claim 1, wherein the portion of the border is configured to form a text.

8. The optical sheet of claim 1, wherein the portion of the border is configured to form a letter.

9. The optical sheet of claim 1, wherein the portion of the border is configured to form a symbol.

10. The optical sheet of claim 1, wherein the portion of the border is configured to form a number.

11. The optical sheet of claim 1, wherein the portion of the border is configured to form a character.

12. The optical sheet of claim 1, wherein the one or more optical elements are arranged randomly.

13. The optical sheet of claim 5, wherein the second region surrounds the first region.

14. The optical sheet of claim 5, wherein the second region adjoins the first region.

15. The illumination system of claim 6, wherein the source of illumination comprises at least one of one or more LEDs, a small volume incandescent bulb or a fluorescent bulb.

16. The illumination system of claim 6, wherein the far-field radiation pattern is selected from a spot light, a flood light or a wash light.

17. The optical sheet of claim 14, wherein the border is the interface between the first region and the second region.

18. An optical sheet comprising:

a plurality of optical elements, at least one optical element of the plurality of optical elements including a curved groove disposed around an optical axis of the at least one optical element, the curved groove having a primary optical facet and a secondary optical facet disposed at an angle with respect to the primary optical facet, wherein the primary optical facet is disposed at a facet angle $\alpha$ less than about 90 degrees with respect to the optical sheet, wherein the secondary optical facet is disposed at a facet angle $\beta$ less than about 90 degrees with respect to a normal to the optical sheet, and wherein the facet angle $\alpha$ departs from a nominal value $\alpha_{nominal}$ by an amount $\Delta\alpha$, wherein a value of $\alpha_{nominal}$ at a distance $r_0$ from the optical axis is determined from a monotonic curve that varies monotonically with distance $r_0$ from the optical axis, and wherein $\Delta\alpha$ is determined by an undulating curve superimposed on the monotonic curve.

19. The optical sheet of claim 18, wherein $\alpha_{nominal}$ varies parabolically or quadratically with distance $r_0$.

20. An illumination system comprising:

a plurality of light emitting diodes; and the optical sheet of claim 18 disposed forward of the plurality of light emitting diodes.

21. The optical sheet of claim 18, wherein the plurality of optical elements are arranged randomly.

22. The optical sheet of claim 18, wherein the at least one optical element comprises a plurality of curved grooves.

* * * * *